US011433286B1

(12) United States Patent
Beye et al.

(10) Patent No.: US 11,433,286 B1
(45) Date of Patent: Sep. 6, 2022

(54) FLYING OBJECT GAME SYSTEM AND METHOD OF USING THE SAME

(71) Applicants: Doug Beye, Jamestown, RI (US); Jared DeAlmo, Warwick, RI (US)

(72) Inventors: Doug Beye, Jamestown, RI (US); Jared DeAlmo, Warwick, RI (US)

( * ) Notice: Subject to any disclaimer, the term of this patent is extended or adjusted under 35 U.S.C. 154(b) by 424 days.

(21) Appl. No.: 16/126,363

(22) Filed: Sep. 10, 2018

Related U.S. Application Data

(60) Provisional application No. 62/556,482, filed on Sep. 10, 2017.

(51) Int. Cl.
*A63B 67/06* (2006.01)
*A63B 63/00* (2006.01)

(52) U.S. Cl.
CPC ..... *A63B 67/06* (2013.01); *A63B 63/008* (2013.01); *A63B 2067/063* (2013.01)

(58) Field of Classification Search
CPC ..... A63B 63/00; A63B 63/008; A63B 67/06; A63B 63/004; A63B 2067/063
USPC ..... 273/398–402; 473/476–478
See application file for complete search history.

(56) References Cited

U.S. PATENT DOCUMENTS 3,908,992 A * 9/1975 Cunningham ..... A63B 63/008 473/477
4,786,053 A * 11/1988 Barnes, Jr. ..... A63B 71/023 273/127 B
5,941,529 A * 8/1999 Kinsey ..... A63B 63/00 273/401
5,944,318 A * 8/1999 Payton ..... A63B 63/00 273/402
6,808,175 B1 * 10/2004 Gleeson ..... A63B 43/007 273/343
6,889,982 B1 * 5/2005 Gove ..... A63B 63/00 273/343
6,899,645 B1 * 5/2005 Hsiao ..... A63B 63/004 273/400
7,090,596 B2 * 8/2006 David ..... A63B 63/00 273/402
7,351,168 B1 * 4/2008 Pannell ..... A63B 63/004 273/400
D576,685 S * 9/2008 Queally ..... D21/302
8,602,921 B2 * 12/2013 Roman ..... A63B 63/008 273/402
8,827,845 B1 * 9/2014 Griffin ..... A63B 63/00 273/400
2002/0125644 A1 * 9/2002 Knudson ..... A63B 63/00 273/398
2006/0091609 A1 * 5/2006 Dovrat ..... A63B 63/00 273/398
2007/0052178 A1 * 3/2007 Cottrell ..... A63B 63/00 273/402
2008/0111312 A1 * 5/2008 Longo ..... A63B 67/06 273/402
2009/0115136 A1 * 5/2009 Voden ..... A63B 21/0053 273/336
2014/0145401 A1 * 5/2014 Powers ..... A63B 67/06 273/402
2014/0183823 A1 * 7/2014 Deming ..... A63B 67/06 273/371

(Continued)

*Primary Examiner* — Jeffrey S Vanderveen
(74) *Attorney, Agent, or Firm* — John E. Boyd; FisherBroyles, LLP

(57) ABSTRACT

Flying object games including systems and methods for playing the same using one or more football goal posts with two or more award slots.

20 Claims, 3 Drawing Sheets

(56) References Cited

U.S. PATENT DOCUMENTS

2016/0023095 A1* 1/2016 Nally ..... A63B 67/06
273/343

* cited by examiner

FLYING OBJECT GAME SYSTEM AND METHOD OF USING THE SAME

RELATED APPLICATIONS

This application claims priority to U.S. Provisional Application No. 62/556,482, filed Jan. 10, 2017, entitled "Flying Object Games, Systems and Methods of Using with the Same", hereby incorporated by reference.

TECHNICAL FIELD

The invention generally relates to flying object games including systems and methods for playing the same.

BACKGROUND

Several publications are referenced in this application. The cited references describe the state of the art to which this invention pertains and are hereby incorporated by reference, particularly the systems and methods set forth in the detailed description and figures of each reference.

Both children and adults have enjoyed outdoor activities for fun, exercise, relaxing, competition and more. There are several flying object games for outdoors including baseball, soccer, tennis, badminton, Frisbee, lawn darts, and many more (e.g. see U.S. Pat. No. 8,287,406 to Biederman et al.; U.S. Pat. No. 5,382,028 to Sciandra et al; and U.S. Patent Publication No. 2017/0021254A1 to Wolf, each hereby incorporated by reference). Such games can provide relaxation, enjoyment, exercise and more. Thus, people are often interested in enjoying new innovative games and activities.

SUMMARY OF INVENTION

One aspect of the invention relates to a game system for playing flying object games.

One embodiment relates to a disk tossing game system played on a supporting surface, the system comprising at least one football goal post comprising a pair of first vertical uprights extending vertically from and at opposite ends of a first horizontal crossbar and supported above the supporting surface by a vertical goal post, the pair of first vertical upright forming an upper award slot and the at least one football goal post comprising a lower rectangular award slot below or above the first horizontal crossbar. Preferably, the system further comprises at least one throwing object.

Another embodiment relates to a disk tossing game system played on a supporting surface, the system comprising at least one football goal post comprising a pair of first vertical uprights extending vertically from and at opposite ends of a first horizontal crossbar, wherein the first horizontal crossbar is supported by a pair of second vertical uprights extending vertically from and at opposite ends of a second horizontal crossbar below the first horizontal crossbar and supported above the supporting surface by a vertical goal post.

Another embodiment relates to a disk tossing game system adapted for playing on a supporting surface, the system comprising at least one football goal post comprising a pair of vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprises a second horizontal crossbar above the first horizontal crossbar and spanning from the first vertical upright to the second vertical upright.

Another embodiment relates to a disk tossing game system played on a supporting surface, the system comprising at least one football goal post comprising a pair of first vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprising a rectangular net above the first crossbar and spanning from the first upright to the second upright.

Another embodiment relates to a disk tossing game system played on a supporting surface comprising:

at least one football goal post comprising a pair of vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprising a second horizontal crossbar above the first horizontal crossbar and spanning from the first vertical upright to the second vertical upright.

Further embodiments of the invention relate to the disk tossing game systems described herein with one or more nets, visual and/or audio mechanisms or the like to indicate when a goal is made and/or catch the disk.

Another aspect of the invention relates to methods for playing a throwing game.

One embodiment relates to methods of for playing a throwing game on a supporting surface comprising:

providing at least one football goal post comprising a pair of first vertical uprights extending vertically from and at opposite ends of a first horizontal crossbar and supported above the supporting surface by a vertical goal post, the pair of first vertical upright forming an upper award slot and the at least one football goal post comprising a lower award slot, and allowing a first team and a second team to take turns as a offensive team throwing the disk and awarding points as follows:

a) awarding six points to the offensive team as a touch down when the disk goes through the lower slot of the football goal post;
b) awarding three points to the offensive team as a field goal when the disk goes through the large uprights;
c) awarding two points to the offensive team as a safety when the disk hits any part of the football goal post and bounces off on either side; and
d) awarding one point to the defensive team as an interception if the disk thrown by the offensive team misses the football goal post completely and the defensive team catches the disk.

The foregoing has outlined some of the aspects of the present invention. These aspects should be construed strictly as illustrative of some of the more prominent features and applications of the invention, rather than as limitations on the invention. Many other beneficial results can be obtained by modifying the embodiments within the scope of the invention. Accordingly, for other objects and a full understanding of the invention, refer to the summary of the invention, the detailed description describing the preferred embodiment in addition to the scope of the invention defined by the claims and the accompanying drawings. The unique features characteristic of this invention and operation will be understood more easily with the description and drawings. It is to be understood that the drawings are for illustration and description only and do not define the limits of the invention.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF PREFERRED EMBODIMENTS

In the following description, for purposes of explanation, specific details are set forth in order to provide a thorough understanding of different aspects of the present invention. It will be evident, however, to one skilled in the art that the present invention as defined by the claims may include some or all of the features or embodiments herein described and may further include obvious modifications and equivalents of the features and concepts described herein.

Definitions

"Supporting surface" is any one or more surfaces capable of supporting the one or more football goal posts of the invention and one or more players such as a lawn, playing court or surface, street or road, parking lot, large room, or beach.

"Award slot" means a opening formed by the components of the system configured to allow the flying object to (i) pass through and/or (ii) be captured (e.g., a net) and can be rectangular, squire, circular, oval or any shape.

One aspect of the invention relates to a game system for playing flying object games, preferably incorporating aspects of American football rules.

Figure 1:
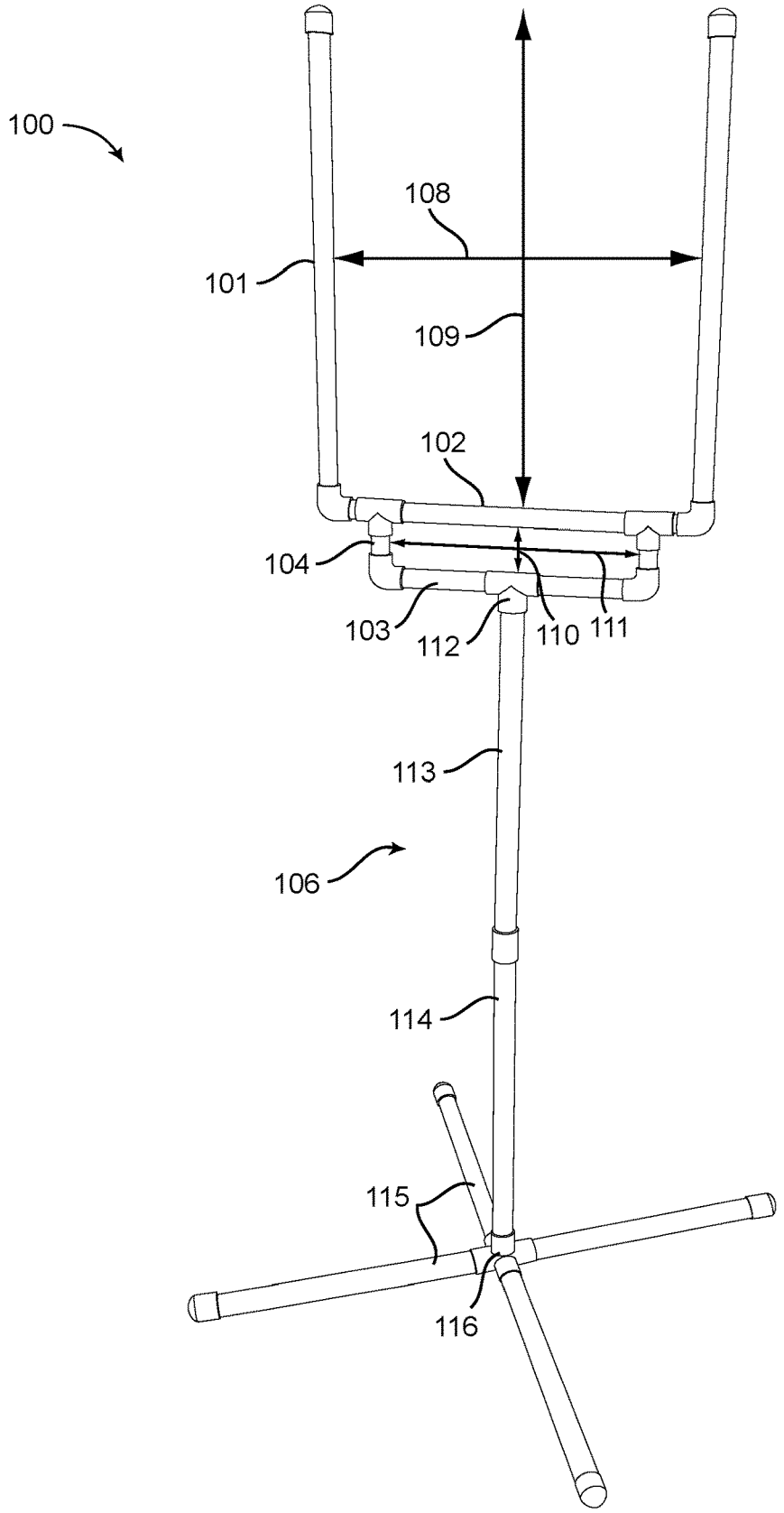
FIG. 1 is a front view on a goal post according to one embodiment of the invention.

FIG. 1 shows a football goal post according to one embodiment of the invention.

One embodiment of the invention relates to a disk tossing game system played on a supporting surface, the system comprising at least one football goal post (100) comprising a pair of first vertical uprights (101) extending vertically from and/or at opposite ends of a first horizontal crossbar (102) and supported above the supporting surface by a vertical goal post (113), the pair of first vertical upright (101) forming an upper award slot (dimensions shown by arrows 108/109) and the at least one football goal post comprising a lower rectangular award slot (dimensions shown by arrows 110/111) below or above the first horizontal crossbar (101).

Preferably, the system further comprises at least one throwing object such as a frisbee or other flying disc (not shown).

Another embodiment of the invention relates to a disk tossing game system played on a supporting surface, the system comprising at least one football goal post (100) comprising a pair of first vertical uprights (101) extending vertically from and/or at opposite ends of a first horizontal crossbar (102), wherein the first horizontal crossbar (102) is supported by a pair of second vertical uprights (104) extending vertically from and/or at opposite ends of a second horizontal crossbar (103) below the first horizontal crossbar (102) and supported above the supporting surface by a vertical goal post (106) (comprised to post pieces (113) and (114). Preferably, the system further comprises at least one throwing object.

Preferably, the components of football goal post (100) may be attached or configured using one or more joints (e.g., T-joints (112) and (116), L-joints, U-joints, connectors or the like). Accordingly, the first vertical uprights (101), for example, are not required to be directly connected to first horizontal crossbar (102) but instead joined using connecting joints as shown in FIG. 1.

Preferably, the uprights (101) are poles or tubes, preferably hollow to reduce weight.

Preferably, the pair of first vertical uprights referred to herein are 1-4 feet in height, more preferably 1.5-2.5 feet in height and most preferably 2 feet and/or are 0.5 to 2 inches in diameter. According to one preferred embodiment, the uprights (101) are 26" in height (plus/minus 1 inch). More preferably, adapted for play on a residential lawn or the like.

Preferably, the pair of first vertical uprights have tips and comprise plastic or rubber caps at the tip of each of the first vertical uprights. Preferably, the caps are adapted to prevent rain from entering into any top opening of the uprights.

Preferably, the first horizontal crossbar is 8 to 20 inches in length, more preferably 10-18, even more preferably 12-16 inches and most preferred 14 inches. According to another preferred embodiment, the first horizontal crossbar is 18 to 26 inches in length, even more preferably 22-24 inches and most preferred 22 inches in length.

Preferably, the entire span 108 soon in FIG. 1 is 10-30 inches, more preferably 15-25 inches and most preferred 20 inches. According to one preferred embodiment, the span (108) is from 20-24 inches, more preferably from 22-23 inches and most preferred 22.5 inches wide.

Preferably, the first horizontal crossbar is preferably 0.5 to 2 inches in diameter.

Preferably, the pair of second vertical uprights (104) are preferably 1 to 10 inches in height, more preferably 2-5 inches in height, even more preferably 2-3 inches and height and most preferably 2.5 inches in height. According to one preferred embodiment, the pair of second vertical uprights (104) are 2-4 inches in height and most preferred 3 inches in height.

Preferably, the pair of second vertical uprights (104) are preferably 0.5 to 2 inches in diameter.

Preferably, the height of award slot (110) is preferably 1 to 10 inches in height, more preferably 2-5 inches in height, even more preferably 2.5-3.5 inches and height and most preferably 3 inches in height.

Preferably, the second horizontal crossbar (103) is 8 to 20 inches in length, preferably 10-16 inches in length, even more preferably 12-14 inches and most preferred 12.5 inches. According to one preferred embodiment, the second horizontal crossbar (103) is 8-14 inches, more preferably 10-11 inches, and most preferred 10.5 inches in length.

According to preferred embodiments, the second horizontal crossbar (103) comprises two pieces which are both 3-10 inches in length, more preferably 4-8 inches, even more preferably 5-7 inches and most preferred 6.25 inches. According to one preferred embodiment, 5-6 inches.

Preferably, the second horizontal crossbar is 0.5 to 2 inches in diameter.

Preferably, the second horizontal crossbar is 5 to 10 inches below the first horizontal crossbar. According to one preferred embodiment, the second horizontal crossbar is 1 to 5 inches below the first horizontal crossbar, preferably 2-4 inches, and most preferably 3 inches.

Preferably, the first horizontal crossbar and the second horizontal crossbar are separated by a distance and the distance is 5 to 10 inches. According to one preferred embodiment, 1 to 5 inches, preferably 2-4 inches, and most preferably 3 inches.

According to preferred embodiments, the football goal post system includes a vertical post (106) to elevate the goal above the ground.

Preferably, the vertical goal post (106) is 30-80 inches in height, more preferably 40-60 inches, even more preferably 45-55 inches. According to one preferred embodiment, 30-40 inches, more preferably 32-38 inches and most preferred 34 inches in height.

Figure 2:
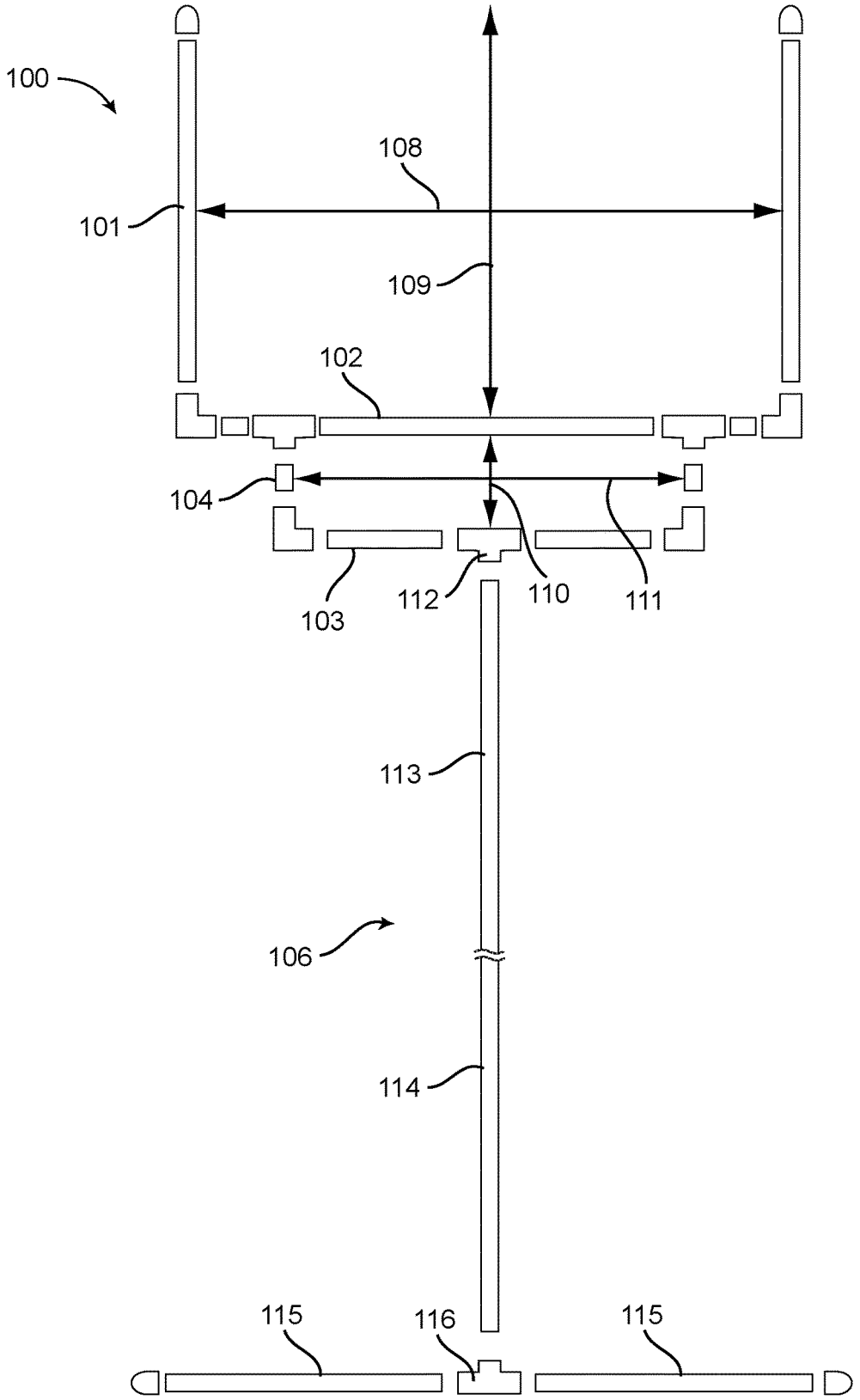
FIG. 2 is a front view of the gold post of FIG. 1 disassembled.

According to preferred embodiment, the vertical goal post (106) comprises two or more pieces (e.g., (113) and (114) in FIGS. 1 and 2) each piece is preferably 10-40 inches, more preferably 15-30 inches, even more preferably 20-25 inches and most preferred 22 inches in height. According to one preferred embodiment, each piece is 10-24 inches, more preferably 14-20 inches, even more preferably 16-18 inches and most preferred 17 inches in length.

Preferably, the vertical goal post 0.5 to 2 inches in diameter.

Preferably, the vertical goal post has an adjustable height.

Preferably, the vertical goal post has an adjustable by telescoping or can be disassembled (e.g., into two or more pieces).

Preferably, the system further comprises a support structure for the goal post.

Preferably, the system further comprises a horizontal X-shaped support (115) that rests on the supporting surface. According to one preferred embodiment, each of the four "legs" of horizontal X-shaped support (115) is 15-25 inches, preferably 16-20 and most preferred 18 inches in length.

Preferably, the system further comprises a disk or plate that rests on the supporting surface and allows the goal post to be attached and supported therefrom.

Preferably, the goal post includes a spike at the lower end and opposite the end attached to the lower cross-bar to facilitate setting up the system.

Preferably, the support structure comprises three or more legs to support the football goal post.

According to preferred embodiments, the system is configured to be assembled and dissembled without any tools, preferably by hand.

Preferably, the components include flexible joints allowing the system to fold and/or collapse for storage.

Preferably, two or more components include two or more parts that can be joined to form the component or separated for storage.

Preferably, the components are inflatable to form the football goal post.

Preferably, the entire football goal post is inflatable.

The system can be made from a variety of materials. Preferably, the components of the football goal post are plastic, more preferably plastic tubes, and even more preferably plastic hollow tubes.

Preferably, the pair of first vertical uprights, the first horizontal crossbar, the pair of second vertical uprights, the second horizontal crossbar and the vertical goal post are made of tubes.

Preferably, the pair of first vertical uprights, the first horizontal crossbar, the pair of second vertical uprights, the second horizontal crossbar and the vertical goal post are made of plastic tubes (e.g., PVC tubing).

Preferably, the pair of first vertical uprights, the first horizontal crossbar, the pair of second vertical uprights, the second horizontal crossbar and the vertical goal post are made of hollow plastic tubes.

Preferably, the pair of first vertical uprights, the first horizontal crossbar, the pair of second vertical uprights, the second horizontal crossbar and the vertical goal post are made of hollow tubes.

Preferably, the tubes have different outer diameters and inner diameters allowing one or more tubes to be stored within one or more other tubes for storage. For example, the vertical goal post (113) is made of two tubes and the first tube fits within the second, e.g., for storage and/or transport.

According to additional preferred embodiments, the system further comprises a net adapted to be attached along at least the first horizontal crossbar and second horizontal cross bar. Preferably, the net is configured to catch the object when thrown through the lower award slot. Even more preferably, the system includes a net to cover the upper award slot.

Preferably, the net spans the rectangular opening formed by the pair of second vertical uprights, the first horizontal crossbar and the second horizontal crossbar.

Preferably, the net is also adapted to be attached to the pair second vertical uprights.

Preferably, the net is attached using snaps or hooks.

According to particularly preferred embodiments, the net is adapted for form a bag for carrying system components including the pair of first vertical uprights, the first horizontal crossbar, the pair of second vertical uprights, the second horizontal crossbar and the vertical goal post when the system components are disassembled.

According to additional preferred embodiments, the system includes at least one throwing object or flying object for playing the game. More preferably, two or more throwing objects.

Preferably, the at least one throwing object is a disk.

Preferably, the at least one throwing object is a frisbee.

Preferably, the at least one throwing object is a toroidal disk having at least a predetermined thickness and a circumference of a predetermined diameter.

Preferably, the at least one throwing object is made of plastic.

Preferably, the at least one throwing object is a 175 gram disk.

Preferably, the at least one throwing object is a frisbee having imprinted or molded laces on a top surface similar to an American football.

FIGS. 1 and 2 show a preferred embodiment of the invention. However, alternative embodiments include other configurations of the football goal posts.

One alternative embodiment relates to a disk tossing game system adapted for playing on a supporting surface, the system comprising:

(a) at least one football goal post comprising a pair of vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprises a second horizontal crossbar above the first horizontal crossbar and spanning from the first vertical upright to the second vertical upright, and (b) at least one throwing object.

Another embodiment relates to a disk tossing game system played on a supporting surface, the system comprising:

(a) at least one football goal post comprising a pair of first vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprising a rectangular net above the first crossbar and spanning from the first upright to the second upright, and (b) at least one throwing object.

Figure 3:
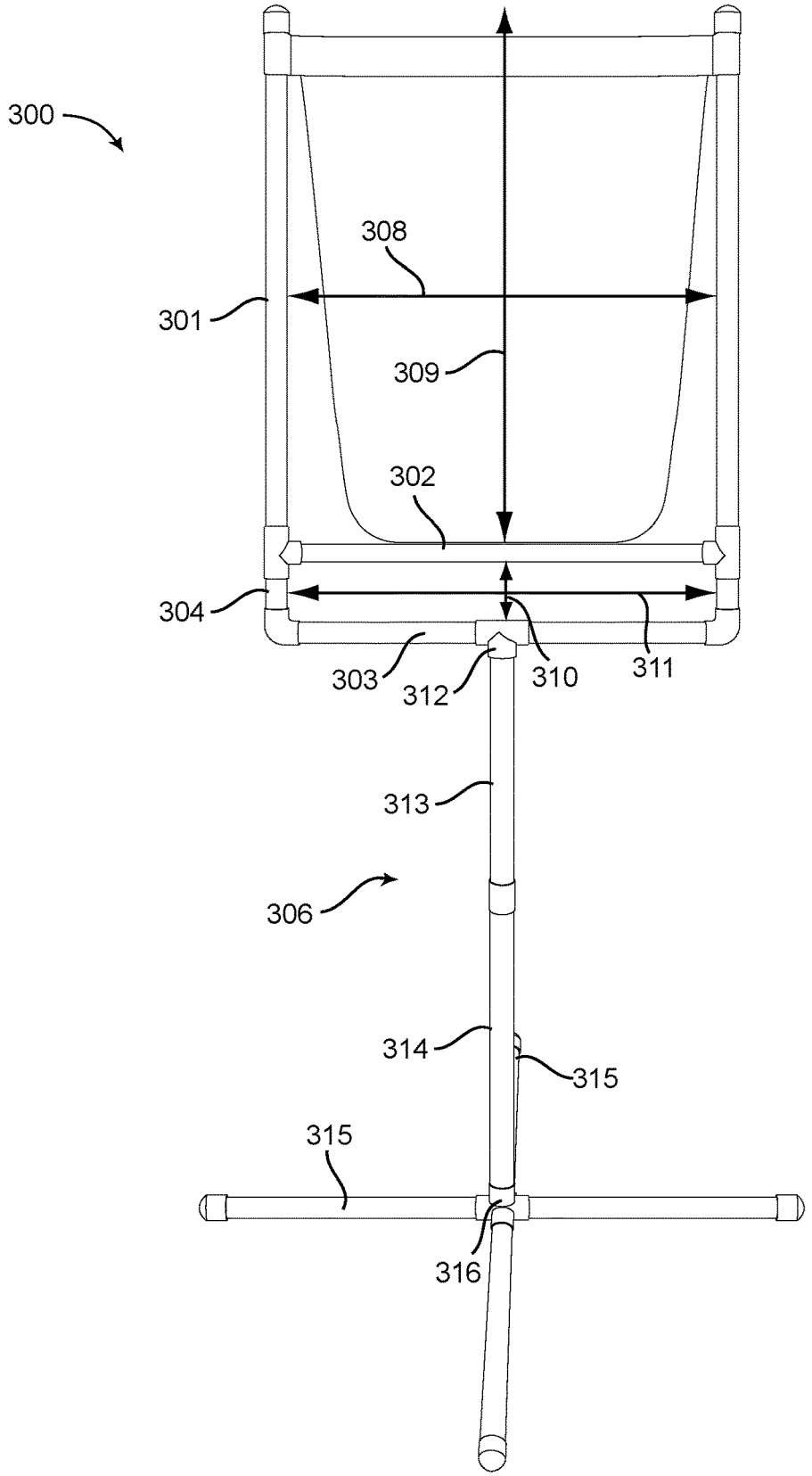
FIG. 3 is front view on a goal post according to another embodiment of the invention.

FIG. 3 is a front schematic view of a disk tossing game system 300 according to one preferred embodiment comprising a pair of first vertical uprights (301) extending vertically from and/or at opposite ends of a first horizontal crossbar (302), wherein the first horizontal crossbar (302) is supported by a pair of second vertical uprights (304) extending vertically from and/or at opposite ends of a second horizontal crossbar (303) below the first horizontal crossbar (302) and supported above the supporting surface by a vertical goal post (306) (comprised to post pieces (313) and (314). Preferably, the system further comprises at least one throwing object.

Preferably, the components of disk tossing game system 300 may be attached or configured using one or more joints (e.g., T-joints (312) and (316), L-joints, U-joints, connectors or the like). Accordingly, the first vertical uprights (301), for example, are not required to be directly connected to first horizontal crossbar (302) but instead joined using connecting joints as shown in FIG. 3. Preferably, the uprights (301) are poles or tubes, preferably hollow to reduce weight. Disk tossing game system 300 shown in FIG. 3 further includes net 317 hung between pair of first vertical uprights 301 by net support 318. According to preferred embodiments, the distance between net support (318) and first horizontal crossbar (302) is preferably between 20-30 inches, more preferably from 22-26 inches, even more preferably 23-24 inches and most preferred 23.5 inches. Preferably, net 317 is configured to provide a signal to users when a disc is thrown through vertical uprights 301 (e.g., by movement and/or sound). Preferably, net 317 is also configured to catch the disc when thrown through vertical uprights 301. Preferably, net 317 is made from a mesh or netting material.

Preferably, rectangular net is configured to form a lower award slot. Alternatively, a rectangular cloth or the like could be used instead of a net.

According to another embodiment, the net is long enough to indicate whether the frisbee went through lower opening.

According to another embodiment, a second net is added for the lower opening to indicate whether the frisbee went through lower opening. Preferably, hung from 302.

According to one preferred embodiment, the net(s) are designed or configured to catch the frisbee. For example, include an area to catch and hold the frisbee to easier to retrieve and/or track the score.

According to another preferred embodiment, the net(s) make a sound when hit with the frisbee. For example, one or more bells are added to the lower net and ring when the frisbee hits.

Another embodiment relates to a disk tossing game system played on a supporting surface comprising:

(a) at least one football goal post comprising a pair of vertical uprights extending vertically from and at opposite ends of a first horizontal crossbar, wherein the first horizontal crossbar is supported above the supporting surface by a vertical goal post and the pair of vertical uprights includes a first vertical upright and a second vertical upright and the football goal post further comprising a second horizontal crossbar above the first horizontal crossbar and spanning from the first vertical upright to the second vertical upright, and (b) at least one throwing object.

Other embodiments relate to configurations wherein the football goal posts includes two or more "lower" or smaller slots. Preferably, one small slot in each inner side of the vertical uprights instead of or in addition to the lower slot shown in FIG. 1 (i.e., on the sides with the larger slot in between). Alternatively, small slots can be positioned above and below the larger award slot.

Still further embodiments relate to configuration where the lower slot shown in FIG. 1 is positioned at the top of the vertical uprights.

Still further embodiments relate to configuration where the lower slot shown in FIG. 1 is larger than the upper slot.

Another aspect of the invention relates to methods of for playing a throwing game using two or more of the field goal post systems as described above.

The methods of playing the throwing game of the invention can involve one player (e.g., practicing), two players (e.g., competing or practicing as a team) or two or more teams with one or more individual players.

Preferably, the game is played outside on a lawn, yard, playing surface, beach, street or other surface suitable for playing the throwing game of the invention.

One embodiment relates to a method of playing a throwing game on a supporting surface comprising:

providing at least one football goal post comprising a pair of first vertical uprights extending vertically from and at opposite ends of a first horizontal crossbar and supported above the supporting surface by a vertical goal post, the pair of first vertical upright forming an upper award slot and the at least one football goal post comprising a lower award slot, and allowing a first team and a second team to take turns as a offensive team throwing the throwing object and awarding points according to whether the object is thrown through a larger slot or smaller slot or hits one of the vertical posts.

Another embodiment relates to a method of playing a throwing game on a supporting surface comprising:

providing at least one football goal post comprising a pair of first vertical uprights extending vertically from and at opposite ends of a first horizontal crossbar and supported above the supporting surface by a vertical goal post, the pair of first vertical upright forming an upper award slot and the at least one football goal post comprising a lower award slot, and allowing a first team and a second team to take turns as a offensive team throwing a disk (or other throwing object) and awarding points as follows:

(i) awarding six points to the offensive team as a touch down when the disk goes through the lower slot of the football goal post;

(ii) awarding three points to the offensive team as a field goal when the disk goes through the large uprights;

(iii) awarding two points to the offensive team as a safety when the disk hits any part of the football goal post and bounces off on either side; and (iv) awarding one point to the defensive team as an interception if the disk thrown by the offensive team misses the football goal post completely and the defensive team catches the disk.

According to embodiment, the method uses two of the football goal posts set up between 10-100 feet from each other, preferably 20-40 feet, more preferably 25-35 feet, and most preferred about 30 feet from each other.

Preferably, the first team and the second team each stand next to their respective football field goal (and more preferably not to step in front when throwing the object).

According to other embodiments, only one goal is used. Preferably, one team will be positioned near the goal, while the other team positioned at a suitable distance (e.g. 20-40 feet from goal) and the teams take turns switching throwing the object.

Preferably, the first team and the second team can choose to stand on either the right or the left of the field goal post.

Preferably, each team includes two or more players, the two or more players should stand on the same side of their field goal post.

According to one preferred embodiment, the method further comprises allowing the defensive team to blitz the offensive team once per game. Preferably, each defender gets one blitz per game. Preferably, for a blitz, the player(s) jump in front of the field goal post. Preferably, the player must yell "blitz" before jumping in front. Preferably, if the defender catches or blocks the Frisbee by knocking it down, this negates any would-be points. Preferably, a "defense" play occurs, for example, when the offense or disk thrower hits the post for a point score (preferably 2 point score) (also known as the safety) the defender has the opportunity to catch the disk and deny the offence the points from being scored. More preferably, if the defender is able to catch the frisbee one handed after it hits any post (as long as it does not go through the uprights for a field goal) and before it hits the ground they can negate the two points the offense would have scored. Preferably, any catches made by the defense must be one handed.

According to one preferred embodiment, the winner of the game is the team to first obtain a certain number of points, preferably 28 points.

Preferably, after the winner reaches the set amount of points (e.g., 28 points) or higher, the opposing team can have a rebuttal if they are able to reach the score of the winner by a touchdown, field goal or safety, e.g., in their next throwing turn. Preferably, if the opposing team obtains the rebuttal tie or beats the winner's score, the game goes into overtime. Preferably, if the opposing team gets the rebuttal gets over the set amount of points (e.g., 28 points) but does not surpass the winner's score, the opposing team loses and no overtime is played.

Preferably, if there is overtime, the score for both the winner and opposing team is reset to 0 and overtime is played to a set amount of points (e.g., 14 points).

Preferably, the overtime winner is the team to first obtain a set amount of points, preferably 14 points. Moreover preferably, after the overtime winner reaches the amount of points (e.g., 14 points) or higher, the opposing team can have a overtime rebuttal if they are able to reach the score of the overtime winner by a touchdown, field goal or safety.

Preferably, if the opposing team obtains the overtime rebuttal tie or beats the overtime winner's score, the game goes into an additional overtime.

Preferably, if the opposing team obtains the overtime rebuttal tie or beats the winner's score, the game goes into overtime. More preferably, if the opposing team gets the overtime rebuttal gets over the set amount of points (e.g., 28 points) but does not surpass the overtime winner's score, the opposing team loses and no overtime is played.

Preferably, there can be endless overtimes as long as the teams continue to play by the rebuttal rules.

According to preferred embodiments of the invention, the throwing object is used as the coin for the coin toss (e.g., the player picks a side of the Frisbee and the Frisbee is tossed).

Another embodiment relates to a method of playing a throwing game on a supporting comprising:

a) allowing each team to get a set of throws per turn (preferably when playing 2 vs 2. each player on each team gets 1 throw per turn); and b) scoring the game as follows:

Offense:

Touchdown (TD)=6 pts when the offense throws the disc through the slot of the opposing team;

Splitter=3 pts when the offense throws the disc through the up uprights of the opposing team;

Banger=1 pt when the offense hits any part of the opposing teams posts and it ricochets to the right or left of the posts and hits the ground.

Defense:

Pick=−1 pt to the offense's score when the disc misses all targets and the defense catches it.

Snagger=1 pt when the defense catches a banger throw from the offense it then negates the would be points from the offense.

Blitz=0 pts when the defense yells blitz and jumps in front of the field goal posts while the disc is in the air to either catch or knock down the offenses disc throw (there is only one blitz allowed per player per game and each team receives one blitz in overtime)

Preferably, the game is played until the first to 25 pts and, preferably win by at least 3 pts with endless rebuttals until there is a determined winner.

Preferably, the game begins with a disc flip of heads or tails called in the air (preferably by the youngest player) and winning team then decides whether to throw first or from which side to throw.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

The scope of the present devices, systems and methods, etc., includes both means plus function and step plus function concepts. However, the claims are not to be interpreted as indicating a "means plus function" relationship unless the word "means" is specifically recited in a claim, and are to be interpreted as indicating a "means plus function" relationship where the word "means" is specifically recited in a claim. Similarly, the claims are not to be interpreted as indicating a "step plus function" relationship unless the word "step" is specifically recited in a claim, and are to be interpreted as indicating a "step plus function" relationship where the word "step" is specifically recited in a claim.

It is understood that the embodiments described herein are for the purpose of elucidation and should not be considered limiting the subject matter of the disclosure. Various modifications, uses, substitutions, combinations, improvements, methods of productions without departing from the scope or spirit of the present invention would be evident to a person skilled in the art.

The invention claimed is:

1. A disk tossing game system played on a supporting surface, the system comprising at least one football goal post comprising a pair of first vertical uprights extending vertically from and at opposite ends of a first horizontal crossbar, wherein the first horizontal crossbar is supported above the supporting surface by a single vertical goal post, the pair of first vertical uprights forming an upper award slot and the at least one football goal post further comprising a second horizontal crossbar above the first horizontal crossbar and extending between the pair of first vertical uprights forming a lower rectangular award slot above the first horizontal crossbar and extending between the pair of first vertical uprights, and wherein the system further comprises a net above the first horizontal crossbar and spanning between the pair of first vertical uprights and wherein the net is adapted to be attached along at least the first horizontal crossbar and the second horizontal cross bar or to be attached to the pair of first vertical uprights.

2. The system of claim 1, wherein the pair of first vertical uprights are 1-4 feet in height and are connected to the first horizontal crossbar by connecting L-joints.

3. The system of claim 1, wherein the pair of first vertical uprights are 0.5 to 2 inches in diameter and each has a tip and comprise a cap at the tip of each of the first vertical uprights.

4. The system of claim 1, wherein said first horizontal crossbar is 8 to 20 inches in length and connected to the single vertical goal post by a T-joint.

5. The system of claim 1, wherein said upper award slot has a width ranging from 10-40 inches extending between the pair of first vertical uprights.

6. The system of claim 1, wherein said lower rectangular award slot has a width ranging from 10-20 inches.

7. The system of claim 1, wherein said vertical goal post has a height ranging from 30-80 inches and is connected to the center of the first horizontal crossbar.

8. The system of claim 1, wherein said vertical goal post comprises two or more pieces adapted to connect to form the vertical goal post.

9. The system of claim 1, wherein said second horizontal crossbar is 8 to 20 inches in length and connected to the pair of first vertical uprights using T-joints.

10. The system of claim 1, wherein the second horizontal crossbar is 5 to 10 inches above the first horizontal crossbar.

11. The system of claim 1, wherein the net is attached to the pair of first vertical uprights.

12. The system of claim 1, further comprising a support structure for the vertical goal post.

13. The system of claim 12, wherein the support structure comprises three or more legs to support the vertical goal post.

14. The system of claim 1, wherein the components include flexible joints allowing the system to fold, disassemble and/or collapse for storage.

15. The system of claim 1, wherein the pair of first vertical uprights, the first horizontal crossbar, the second horizontal crossbar and the vertical goal post are made of plastic tubes.

16. The system of claim 1, wherein the at least one throwing object is a disk.

17. The system of claim 1, wherein the net is attached along at least the first horizontal crossbar and the second horizontal cross bar.

18. A disk tossing game system played on a supporting surface, the system comprising:

(a) at least one football goal post comprising a pair of first vertical uprights extending vertically from and at opposite ends of a first horizontal crossbar, wherein the first horizontal crossbar is supported by a pair of second vertical uprights extending vertically from and at opposite ends of a second horizontal crossbar below the first horizontal crossbar and supported above the supporting surface by a single vertical goal post, and (b) at least one throwing object, wherein the at least one football goal post further comprises a net attached to the pair of first vertical uprights.

19. A method of playing a throwing game using the disk tossing game system of claim 1 on a supporting surface, the method comprising:

allowing a first team and a second team to take turns as an offensive team throwing a disk and awarding points when the disk goes through the lower rectangular award slot of the football goal post and when the disk goes through the d) upper award slot.

20. The method of claim 18, wherein the net is attached to the pair of first vertical uprights.

* * * * *